United States Patent [19]

Hartman et al.

[11] 4,299,636

[45] Nov. 10, 1981

[54] ALKOXY SUBSTITUTED AROMATIC STABILIZERS FOR CROSSLINKED CMDB PROPELLANT

[75] Inventors: Kenneth O. Hartman, LaVale, Md.; James W. Morton, Ridgeley, W. Va.

[73] Assignee: Hercules Incorporated, Wilmington, Del.

[21] Appl. No.: 458,383

[22] Filed: Apr. 5, 1974

[51] Int. Cl.[3] ..... C06B 45/10

[52] U.S. Cl. ..... 149/19.4; 149/19.8

[58] Field of Search ..... 149/19.4, 19.8

[56] References Cited

U.S. PATENT DOCUMENTS

| | | | |
|---|---|---|---|
| 3,884,736 | 5/1975 | Stack | 149/19.8 X |
| 3,894,894 | 7/1975 | Elrick | 149/19.8 X |
| 3,905,846 | 9/1975 | Berta | 149/19.4 |
| 3,914,142 | 10/1975 | Sayles | 149/19.8 |

*Primary Examiner*—Edward A. Miller

[57] ABSTRACT

A class of alkoxy substituted aromatic stabilizers is provided for double base propellant. These stabilizers are soluble in the energetic plasticizer employed in the propellant. These stabilizers are particularly suitable and useful in diisocyanate crosslinked composite modified double base propellant because they do not react with the crosslinking agents during preparation of the propellant and impart improved thermal stability to such propellants.

8 Claims, No Drawings

ALKOXY SUBSTITUTED AROMATIC STABILIZERS FOR CROSSLINKED CMDB PROPELLANT

This invention relates to a class of alkoxy substituted aromatic compounds which are thermal stabilizers for double base propellants. More particularly, this invention relates to alkoxy substituted aromatic compounds which are soluble thermal stabilizers for diisocyanate crosslinked composite modified double base propellants containing ammonium perchlorate oxidizer.

Composite modified double base propellants (CMDB) are comprised of nitrocellulose, an energetic plasticizer, and solid organic or inorganic oxidizers. Various stabilizers are employed in CMDB to improve the thermal stability of the propellants. In preparation of CMDB by the slurry casting process it is desirable to crosslink the nitrocellulose binder in order to obtain improved and reproducible mechanical properties for the cured propellant. Resorcinol, the most commonly employed thermal stabilizer for CMDB, has not proved totally satisfactory as a stabilizer in crosslinked CMDB because of the reaction of resorcinol with diisocyanate crosslinking agents. Accordingly, considerable research effort has been undertaken to find a suitable replacement for resorcinol in diisocyanate crosslinked CMDB. One class of compounds found to be satisfactory stabilizers for diisocyanate crosslinked CMDB are urethane compounds such as 1,3-bis(N-m-methoxyphenyl urethane) benzene. These urethane compounds are the subject of a patent application of James Donald Gibson entitled "Novel Urethane Compounds and CMDB Propellants Stabilized Therewith (U)", Ser. No. 413,401, filed Nov. 14, 1973. A principal disadvantage of the use of these compounds as stabilizers for CMDB is that they are only slightly soluble in the nitrocellulose-energetic plasticizer lacquer and therefore processing of CMDB containing this type of stabilizer is difficult.

In accordance with this invention, a class of alkoxy substituted compounds has been discovered, which compounds are (a) unreactive with diisocyanate crosslinking agents, (b) soluble in the energetic plasticizer employed in preparation of the CMDB propellant and (c) function as effective thermal stabilizers in CMDB. The stabilizers of this invention comprise at least one alkoxy substituted aromatic compound of the formula

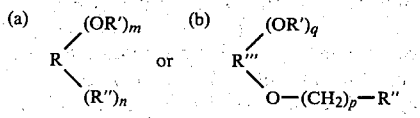

wherein

R is a benzene, biphenyl or naphthalene nucleus,

R' is an alkyl radical having from 1 to 4 carbon atoms

R'' is, phenoxy or alkoxy substituted phenoxy in which the alkoxy substituent has from 1 to 4 carbon atoms, R''' is a benzene nucleus, and m is 1–3, n is 0–1, p is 1–6, and q is 1–2.

Illustrative alkoxy substituted aromatic compounds of this invention as defined herein include 1,3,5-trimethoxybenzene; 3,3'-dimethoxybiphenyl; 1-methoxy-3-phenoxybenzene; 2-methoxynaphthalene; 1,7-dimethoxynaphthalene; bis(m-methoxyphenoxy) methane; bis(m-methoxyphenoxy)pentane; and the like.

The following examples more fully illustrate this invention. In the examples, parts and percentages are by weight unless otherwise specified.

EXAMPLES 1-9

Composite modified double base propellant is prepared comprising nitroglycerin, nitrocellulose, desensitizing agent, stabilizer, a mixture of organic and inorganic oxidizers and a diisocyanate crosslinking agent. The crosslinking catalyst is omitted from the mixture. An alkoxy substituted aromatic stabilizer of this invention is added to the uncured propellant and mixed therewith. The aromatic stabilizer is employed in an amount of 1.0% by weight, based on the weight of the propellant. The aromatic stabilizer rapidly dissolves in the nitrocellulose-nitroglycerin lacquer. The resulting uncured propellant is tested for thermal stability at 80° C., 100° C., 110° C., and 140° C. and gassing rate is measured at 110° C. and 90° C. The foregoing procedure is repeated for evaluation of additional alkoxy substituted aromatic stabilizers of this invention as identified in Table I. For comparison purposes, a resorcinol stabilized CMDB propellant (noncrosslinked) containing about 0.7% by weight resorcinol based on the weight of the propellant is subjected to the same solubility tests (Example 8) for comparison purposes. The resorcinol stabilized CMDB propellant while of a different overall composition is included here to provide comparative test data as a CMDB propellant exhibiting acceptable stability properties. Also included for purposes of comparing stability is the same CMDB propellant composition as Examples 1–7 which has been stabilized with 1,3(N-m-methoxyphenyl urethane) benzene (Example 9).

TABLE I

Thermal Stability of Stabilized CMDB (Induction Time-Minutes)

| Temp. °C. | Stabilizer[1] MPB Ex. 1 | MN Ex. 2 | DMN Ex. 3 | DMPB Ex. 4 | TMB Ex. 5 | BMPN Ex. 6 | BMPP Ex. 7 | RES Ex. 8 | BMUB Ex. 9 |
|---|---|---|---|---|---|---|---|---|---|
| 140 | 58 | 64 | 64 | 50 | 63 | 63 | 38 | 32 | 41 |
| 110 | 1200 | 1360 | 1000 | 840 | 126 | 2200 | 1800 | 1200 | 2580 |
| 100 | 8800 | 5000 | 5340 | 5100 | 5370 | 6700 | 6500 | 4300 | 5200 |
| 80 | 83500 | 108000 | 83500 | 82080 | 56880 | 92000 | 78000 | 54700 | 83520 |
| | Gassing Rate (mm Hg/min) | | | | | | | | |
| 110 | 0.31 | 0.30 | 0.36 | .33 | .48 | — | — | 0.46 | 0.35 |

TABLE I-continued

| Temp. °C. | Thermal Stability of Stabilized CMDB (Induction Time-Minutes) Stabilizer[1] MPB Ex. 1 | MN Ex. 2 | DMN Ex. 3 | DMPB Ex. 4 | TMB Ex. 5 | BMPN Ex. 6 | BMPP Ex. 7 | RES Ex. 8 | BMUB Ex. 9 |
|---|---|---|---|---|---|---|---|---|---|
| 90 | 0.008 | 0.013 | 0.011 | .011 | .012 | — | — | 0.032 | 0.009 |

[1]Stabilizers
MPB - 1-methoxy-3-phenoxybenzene
MN - 2-methoxynaphthalene
DMN - 1,7-dimethoxynaphthalene
DMBP - 3,3'-dimethoxybiphenyl
TMB - 1,3,5-trimethoxybenzene
BMPM - bis (m-methoxyphenoxy) methane
BMPP - bis (m-methoxyphenoxy) pentane
RES - resorcinol
BMUB - 1,3-bis (N-m-methoxyphenyl urethane) benzene The induction time at 80° C. is determined by the flammability test. In this test a one-inch cube of propellant is wrapped in aluminum foil and is placed in a $2\frac{1}{4}''\times 2\frac{1}{4}''\times 6''$ metal container open on one end. A wire screen and aluminum foil are used to cover the open end of the container. The container is placed in a 80° C. constant temperature oven. The container is observed every day until the propellant cube burns, as indicated by burned aluminum foil cover on the container.

The induction time at 100° C. is determined by the Taliani test method and Taliani test apparatus. This apparatus is a constant gas volume system with a glass tube connected to a mercury manometer. The glass tube is heated by an electrically heated metal block. A propellant sample of 0.01 gram is placed in the glass bulb, and the glass bulb is then placed in the heated block. The pressure of the system resulting from gassing of the propellant is recorded at appropriate intervals and the time at which pressure rise is rapid is the induction time.

The induction time at 140° C. is determined on a Perkin-Elmer Differential Scanning Calorimeter Model DSC 1B. A sample of 0.01 gram of CMDB propellant is placed in the cup of the calorimeter which is maintained at a constant temperature of 140° C. The effectiveness of the stabilizer is determined by measuring the time, in minutes, until an exothermic peak is reached, which signifies propellant decomposition.

The gassing rate at 110° C. and 90° C. is determined by using the Taliani apparatus and method described above. However, the sample size for these tests is one-gram. In these tests the data acquired is the rate of gas evolution during the induction period which is determined from the slope of a line developed by plotting gas pressure (mm Hg) against time (minutes).

From inspection of the results of the thermal stability tests as set forth in Table I, it is concluded that the alkoxy substituted aromatic stabilizers of this invention are effective stabilizers for diisocyanate crosslinked CMDB propellant, yielding a crosslinked CMDB propellant that exhibits stability properties which compare favorably with those of the control propellant (Example 8).

EXAMPLES 10-11

CMDB propellants are prepared as in Example 1 utilizing 1-methoxy-3-phenoxybenzene, an alkoxy substituted aromatic stabilizer of this invention, as the stabilizer, and utilizing 1,3-bis(N-m-methoxyphenyl urethane) benzene as a stabilizer for control purposes. These stabilizers are employed in an amount of 1.0% by weight, based on the weight of the total propellant composition. In these examples, a curing catalyst is employed. The propellant is cured. Thermal stability tests are run on the cured propellant at 80° C., 100° C., 110° C. and 140° C. and gassing rates are determined, utilizing the method previously described. Results of these tests are set forth in Table II.

TABLE II

| Temp. °C. | Ex. 10 MPB[1] Induction (Minutes) | Ex. 11 BMUB[2] Induction (Minutes) |
|---|---|---|
| 140 | 42 | 40 |
| 110 | 1560 | 1500 |
| 100 | 8450 | 8300 |
| 80 | 58 days | 68 days |
| | Gassing Rate (mm Hg/Min.) | |
| 110 | 0.27 | 0.32 |
| 90 | 0.009 | 0.012 |

[1]MPB - 1-methoxy-3-phenoxybenzene
[2]BMUB - 1,3-bis(N-m-methoxyphenyl urethane) benzene

EXAMPLES 12-13

Large scale thermal stability tests are conducted on a cured diisocyanate crosslinked CMDB propellant of similar composition to the propellant of Example 1, but containing 0.7% by weight of stabilizer, based on the weight of the propellant. In these examples 1-methoxy-3-phenoxybenzene, an alkoxy substituted aromatic stabilizer of this invention (Example 12) is compared to 1,3-bis(N-m-methoxyphenyl urethane) benzene, a control (Example 13), for relative effectiveness utilizing the cracking cube test. In the cracking cube test, two-inch cubes or four-inch cubes of propellant are wrapped in aluminum foil and placed in either $2\frac{1}{4}''\times 2\frac{1}{4}''\times 6''$ or $4\frac{1}{4}''\times 4\frac{1}{4}''\times 5''$ metal containers open on one end. A metal lid is sealed to this opening with masking tape. The container is placed in a constant temperature oven at the appropriate temperature. Twice weekly the cubes are removed from the oven for about 10 minutes and X-rayed to detect internal cracks. The test is terminated when definite defects such as cracks or voids appear. Cracks or voids are found in the propellant as the result of testing after the number of days set forth in Table III.

TABLE III

| Cracking Cube Test | Ex. 12 MPB[1] Time (days) | Ex. 13 BMUB[2] Time (days) |
|---|---|---|
| 80° C. - 2" cubes | 7 to 13 | 2 |
| 70° C. - 4" cubes | 16 to 20 | 7 to 10 |

TABLE III-continued

| Cracking Cube Test | Ex. 12 MPB[1] Time (days) | Ex. 13 BMUB[2] Time (days) |
|---|---|---|
| 60° C. - 4" cubes | 116 | 21 to 55 |

[1]1-methoxy-3-phenoxybenzene
[2]1,3-bis(N-m-methoxyphenyl urethane) benzene

EXAMPLES 14-15

CMDB propellants as designated in Example 1 are cured. The propellants are stabilized with 1-methoxy-3-phenoxybenzene and with 1,3-bis(N-m-methoxyphenyl urethane) benzene for comparison purposes. The stabilizer level in both propellants is 1.0% based on the weight of the cured propellant. One gram samples of each propellant are cut into small wafers of from one to two millimeters in thickness and the wafers are each placed in a glass vial. The glass vials are evacuated to a reduced pressure of less than one mm Hg and are heated to 60° C. The vials are maintained at 60° C. for six weeks. After six weeks, the gassing rate of the propellants is measured. The 1-methoxy-3-phenoxy benzene stabilized propellant (Example 14) has a gassing rate of less than $2\times10^{-11}$ moles/gram-minute while the control propellant (Example 15) has a gassing rate of $4\times10^{-11}$ moles/gram-minute.

The alkoxy substituted aromatic stabilizers of this invention are particularly suitable for use in diisocyanate cross-linked CMDB because of their solubility in the nitrate ester plasticizer which is present in CMDB propellants. These stabilizers can also be employed in double base propellant (noncrosslinked). In double base propellant these stabilizers can be added directly to casting solvent comprising nitroglycerin or other nitrate ester plasticizers when, for example, the propellant is manufactured by the cast method, i.e., utilizing casting powder and casting solvent. The alkoxy substituted aromatic stabilizers of this invention are employed in CMDB propellant in an amount of from about 0.2% to about 1.5% by weight, and preferably in an amount of from about 0.5 to about 1.0% by weight, based on the total weight of the propellant composition.

While the alkoxy substituted aromatic stabilizers of this invention can be employed in double base propellants, the principal advantages of these stabilizers is realized in diisocyanate cross-linked CMDB.

The preferred energetic plasticizer in CMDB propellant is nitroglycerin but other energetic plasticizers can also be used. Illustrative energetic nitrate ester plasticizers in which the stabilizer of this invention are soluble include trimethylolethane trinitrate; diethyleneglycol dinitrate; triethyleneglycol dinitrate; 1,2,4-butanetriol trinitrate; bis(dinitropropyl) acetal; bis(dinitropropyl) formal; glycerol monolacetate trinitrate; glycol dinitrate; nitroisobutylglycerol trinitrate; and the like.

The solid oxidizing agents employed in CMDB propellant can be inorganic or organic oxidizing agents. Illustrative inorganic oxidizing agents are ammonium perchlorate, and ammonium, alkali metal, or alkaline earth metal nitrates which can be used alone or in mixtures with other inorganic oxidizing salts such as chromates, dichromates, permanganates, chlorates and perchlorates of the alkali or alkaline earth metals or ammonia. Organic oxidizing agents which can be used include cyclotrimethylene trinitramine; cyclotetramethylene tetranitramine; pentaerythritol tetranitrate; dipentaerythritol hexanitrate; ethylene dinitramine; 2,4,2',4'-tetranitro-oxanilide; 2,4,6,2',6'-hexanitro-oxanilide; mannitol hexanitrate; nitroguanidine; lead 2,4-dinitroresorcinate; lead 4,6-dinitroresorcinate; trinitrotoluene; and mixtures thereof with each other or with one or more inorganic oxidizing salts.

Metal fuels which can be employed in CMDB propellants include aluminum, aluminum hydride, beryllium, beryllium hydride, and the like.

Isocyanates which can be used as crosslinking agents in the preparation of CMDB propellants include any isocyanate which crosslinks nitrocellulose. Illustrative isocyanates which can be used are aliphatic and aromatic diisocyanates, such as ethylene diisocyanate; trimethylene diisocyanate; propylene-1,2-diisocyanate; hexamethylene diisocyanate; 1-propylene-1,2-diisocyanate; ethylidene diisocyanate; cyclohexylene-1,2-diisocyanate; cyclopentylidene diisocyante; tolyl diisocyanate; naphthylene-1,4-diisocyanate; xylylene-1,3-diisocyanate and the like. The foregoing list is in no way limiting to the isocyanate crosslinking agent that can be used in the preparation of CMDB propellant.

We claim:

1. In a diisocyanate crosslinked composite modified double base propellant containing a thermal stabilizer, the improvement comprising a thermal stabilizer comprising at least one alkoxy substituted aromatic compound having the formula

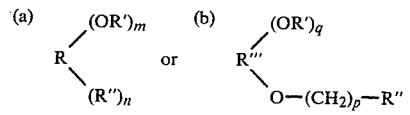

wherein R is a benzene, biphenyl or naphthalene nucleus,

R' is an alkyl radical having from 1 to 4 carbon atoms,

R'' is phenoxy or alkoxy substituted phenoxy in which the alkoxy substituent has from 1 to 4 carbon atoms, R''' is a benzene nucleus, and m is 1–3, n is 0–1, p is 1–6, and q is 1–2, said compound being employed in an amount of from about 0.2% to about 1.5% by weight, based on the weight of the propellant composition.

2. The improved propellant of claim 1 in which the alkoxy substituted compound is 1,3,5-trimethoxybenzene.

3. The improved propellant of claim 1 in which the alkoxy substituted compound is 3,3'-dimethoxybiphenyl.

4. The improved propellant of claim 1 in which the alkoxy substituted compound is 1methoxy-3-phenoxybenzene.

5. The improved propellant of claim 1 in which the alkoxy substituted compound is 2-methoxynaphthalene.

6. The improved propellant of claim 1 in which the alkoxy substituted compound is 1,7-dimethoxynaphthalene.

7. The improved propellant of claim 1 in which the alkoxy substituted compound is bis(m-methoxyphenoxy) methane.

8. The improved propellant of claim 1 in which the alkoxy substituted compound is bis(m-methoxyphenoxy) pentane.

* * * * *